US005479244A

United States Patent [19]

Kashihara et al.

[11] Patent Number: 5,479,244

[45] Date of Patent: Dec. 26, 1995

[54] CHARGER FOR CHARGING AN IMAGE HOLDING MEMBER INCLUDED IN AN IMAGE FORMING APPARATUS

[75] Inventors: Mabumi Kashihara; Hisashi Fukasawa, both of Tokyo, Japan

[73] Assignee: NEC Corporation, Japan

[21] Appl. No.: 291,883

[22] Filed: Aug. 17, 1994

[30] Foreign Application Priority Data

Sep. 29, 1993 [JP] Japan ..... 5-241893
Oct. 7, 1993 [JP] Japan ..... 5-251782

[51] Int. Cl.[6] ..... G03G 15/02
[52] U.S. Cl. ..... 355/219; 361/221
[58] Field of Search ..... 355/219; 361/220, 361/221, 225

[56] References Cited

U.S. PATENT DOCUMENTS 5,146,281 9/1992 Kisu ..... 355/219
5,245,386 9/1993 Asano et al. ..... 355/219

FOREIGN PATENT DOCUMENTS 1-267667 10/1989 Japan .

*Primary Examiner*—William J. Royer
*Attorney, Agent, or Firm*—Ostrolenk, Faber, Gerb & Soffen

[57] ABSTRACT

When a resolution R (dpi) and a process speed (mm/sec) are determined, a voltage generating circuit 100 applies to a charging member a voltage consisting of an AC component having a frequency f which lies in a range having a maximum value and a minimum value determined by RS/25.4±120 (Hz), and a DC component superimposed on the AC component. The DC voltage should only be 0.5 kV to 1.2 kV while the peak-to-peak voltage of the AC component is selected to be slightly higher than the DC voltage. The peak-to-peak voltage should be higher than a discharge start voltage; a sufficient discharge occurs when it ranges from 0.9 kV to 1.3 kV. In this configuration, not only clear-cut character images are printed without regard to changes in environment, but also mesh images are free from moire and vertical stripes.

8 Claims, 3 Drawing Sheets

CHARGER FOR CHARGING AN IMAGE HOLDING MEMBER INCLUDED IN AN IMAGE FORMING APPARATUS

BACKGROUND OF THE INVENTION

1. Field of the Invention

The present invention relates to a charger for a printer, facsimile apparatus or similar electrophotographic image forming apparatus and, more particularly, to a charger capable of charging a desired object uniformly.

2. Description of the Prior Art

In an electrophotographic process, a photoconductive element or similar image holding member has the surface thereof often charged by a corona discharger. A corona discharger is capable of charging the surface of the image holding member to a preselected potential uniformly. However, generation of ozone is the problem with a corona discharger. To reduce ozone, there has been proposed a charger using a charging member in the form of a brush or roller and holding it in contact with a desired object while charging the object. The brush type charger has a laminate structure made up of an insulative substrate, a conductive layer formed on the substrate to be applied with a voltage, and a fur brush implemented by low resistance fibers. The brush may comprise a rotatable brush roller or a flat brush.

It has been customary with the brush type charger to apply only a DC voltage thereto. This brings about a problem that the charge potential deposited by the charger is susceptible to environment. Specifically, when temperature and humidity are low, the resistance of the brush increases to, in turn, lower the charge potential; in a hot and humid environment, the resistance of the brush decreases to, in turn, raise the charge potential. Particularly, when temperature and humidity are low, a streamer discharger occurs and causes white spots to appear in a printed mesh image.

In light of the above, Japanese Patent Laid-Open Publication No. 1-267667 issued on Oct. 25, 1989 teaches a charger capable of charging the surface of an image holding member uniformly without regard to changes in environment. This charger is implemented as a roller, brush or similar charging member and applies to the image holding member a voltage having a DC component and an AC component superimposed on each other. The AC voltage has a peak-to-peak voltage more than twice as high as a charge start voltage. Why this kind of scheme sets up uniform charging is, presumably, that the AC voltage transfers a charge not only from the charging member to the image holding member but also from the latter to the former; the reverse transfer from the latter to the former renders the charge uniform even when the charge on the image holding member is locally excessive.

The superimposed DC-AC scheme stated above is advantageously applicable to ordinary characters and lines to be printed. However, when it comes to an apparatus of the kind printing mesh images including halftone images, the dot size becomes irregular and, therefore, moire becomes conspicuous. In the worst case, white vertical stripes appear in the resulting image. Such an occurrence is particularly conspicuous due to the AC voltage applied to the charging member.

SUMMARY OF THE INVENTION

It is, therefore, an object of the present invention to provide a charger capable of printing all kinds of images in a desirable manner, e.g., printing a mesh image free from irregular dot size, moire, and stripes.

It is another object of the present invention to provide a charger capable of charging the surface of an image holding member uniformly without regard to changes in environment.

A charger of the present invention has a charging member held in contact with an image holding member of an electrophotographic apparatus, and a voltage generating circuit. The voltage generating circuit applies to the charging member a voltage having an AC component having a predetermined frequency and a DC component superimposed on each other.

The frequency of the AC component is the decisive factor in charging the image holding member uniformly. When the frequency is excessively low, the image holding member cannot be uniformly charged; a mesh image printed in such a condition would be a mixture of small dots and normal dots and, therefore, suffer from moire. Conversely, should the frequency be excessively high, white vertical stripes would appear in a mesh image. In this way, high quality images are not achievable unless the AC frequency is optimal.

The optimal value fO (Hz) of the AC frequency is determined by a resolution R (dots per inch or dpi) of an image and a process speed S (mm/soc) representative of a speed at which the surface of the image holding member moves. Assuming the image holding member in the form of a photoconductive drum, the process speed S is the surface speed of the drum which rotates during charging and development. The length L of one dot in the subs canning direction is 25.4/R (ram), while the time T necessary for the surface of the image holding member to move the distance L (mm) is L/S (sec). The optimal value fO of the AC component is the reciprocal of T and expressed as:

$$fO=1/T=RS/25.4\ (\text{Hz}) \qquad \text{Eq. (1)}$$

Experiments showed that when the image holding member is charged by the AC voltage in synchronism with the period of time T, moire does not occur, the image holding member is free from excessive charging, and white vertical dots do not appear in the resulting image. It was found that when the AC frequency f is fO±120 (Hz), moire and white vertical stripes are not noticeable.

The voltage generating circuit applies to the charging member a voltage having a DC component superimposed on an AC component whose frequency f lies in a range having a maximum value and a minimum value determined by RS/25.4±120 (Hz).

BRIEF DESCRIPTION OF THE DRAWINGS

The above and other objects, features and advantages of the present invention will become more apparent from the following detailed description taken with the accompanying drawings in which.

DETAILED DESCRIPTION OF THE PREFERRED EMBODIMENT

Figure 1:
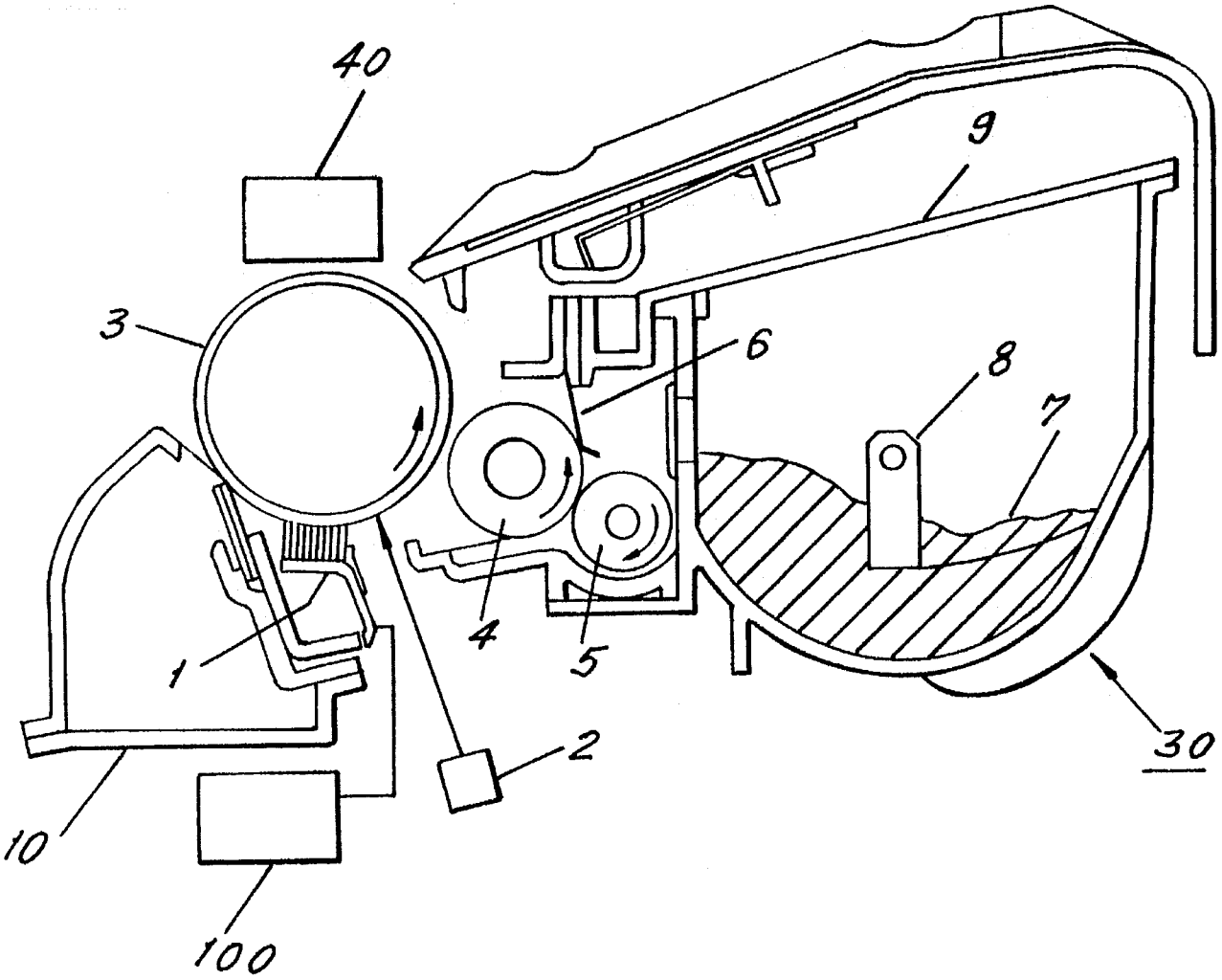
FIG. 1 is a section of an image forming apparatus implemented with a charger embodying the present invention.

Referring to FIG. 1 of the drawings, an image forming apparatus implemented with a charger embodying the present invention is shown. As shown, the apparatus has a charging member 1 in the form of a brush, a light source 2 for exposure, a photoconductive drum 3 having a photoconductive film on the surface thereof, a developing unit 30, an image transfer unit 40, and a cleaner 10. The developing unit 30 has a toner roller 4, a toner supply roller 5, and a hopper 9 storing a toner 7 therein.

Figure 2:
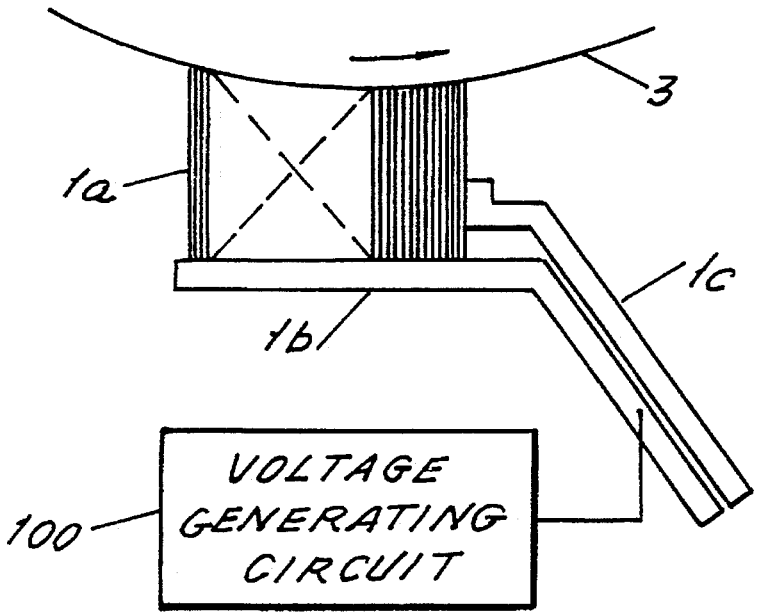
FIG. 2 is a front view of the embodiment.

A charger is made up of the charging member 1 and a voltage generating circuit 100. As shown in FIG. 2 specifically, the voltage generating circuit 100 applies a DC biased AC voltage to the charging member 1. The charging device uniformly charges the drum 3 to deposit an initial voltage on the surface thereof. The drum 3 is rotatable counterclockwise, as viewed in the figures, at a constant speed. A bias voltage of −150 V is applied to the drum 3 in order to promote the charging of the drum 3. The light source 2 comprises, for example, a laser or an LED (Light Emitting Diode) which emits light in accordance with image data. Light issuing from the light source 2 electrostatically forms a latent image on the surface of the drum 3.

The toner, or developer, 7 is fed from the hopper 9 to the supply roller 5 by an agitator 8 and handed over from the supply roller 5 to the toner roller 4. The supply roller 5 is made of aluminum or similar conductive material or of foam urethane, foam silicon or similar insulative material. The toner roller 4 is made of an insulative material, e.g., silicon rubber, urethane rubber, nitributyrene rubber, natural rubber, or foam urethane, foam silicon or similar foam material. A doctor blade 6 regulates the amount of the toner 7 deposited on the toner roller 4, thereby forming a thin toner layer uniformly on the roller 4. At this instant, the toner 7 is charged by friction. A voltage opposite in polarity to the chargeability of the toner 7 is applied to the toner roller 4. In this condition, when the toner 7 charged and deposited on the toner roller 4 in a thin layer faces the drum 3, it is transferred from the roller 4 to the latent image on the drum 3 by an electric field. As a result, the toner 7 develops the latent image to produce a corresponding toner image.

The toner image is transferred from the drum 3 to a plain paper by a transferring device 40, postcard or similar recording medium. Subsequently, the recording medium is conveyed to a fixing unit to have the toner image fixed thereon. After the image transfer, the toner remaining on the drum 3 is removed by the cleaner 10.

Figure 3:
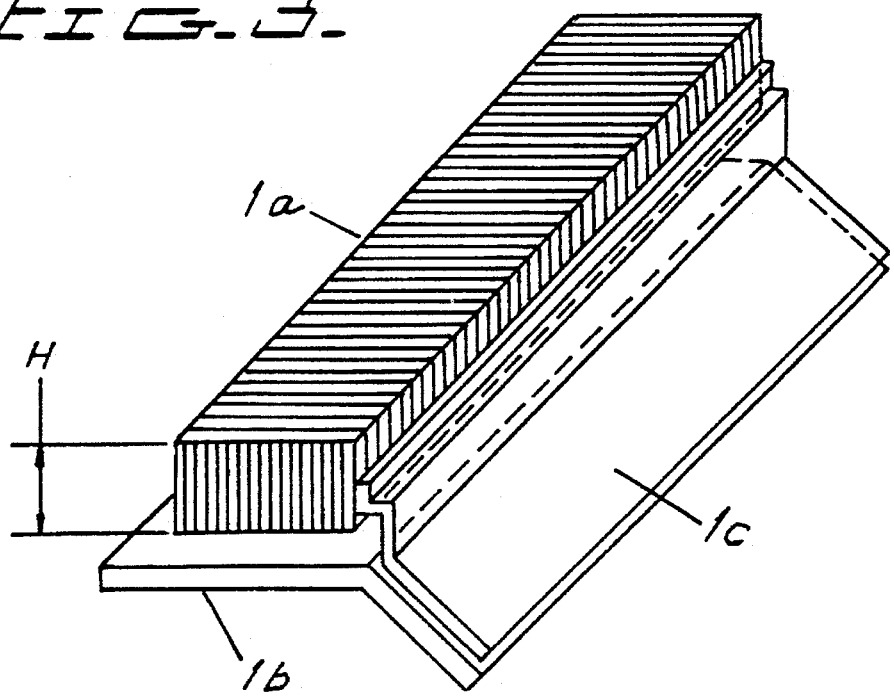
FIG. 3 is a perspective view showing a specific configuration of a charging member shown in FIG. 2.

As shown in FIGS. 2 and 3, the charging member 1 has fine fibers or brush 1*a*, a conductive plate 1*b* made of stainless steel, and a guard 1*c* made of ABS resin. The fibers 1*a* are implemented by a synthetic resin, e.g. acryl, rayon, polyester, polypropyrene or polycarbonate; the fibers are implanted in the conductive plate 1*b* in a density of 50,000/inch$^2$. These fibers each have a length or height H of 5 mm, thickness of 6.2 denier, and resistance of $1\times10^3$ Ωcm to $1\times10^4$ Ωcm. The tips of the fibers 1*a* contact the surface of the drum 3. The guard 1*c* supports the sides of the fibers 1*a* in order to prevent them from collapsing when the drum 3 is rotated.

Figure 4:
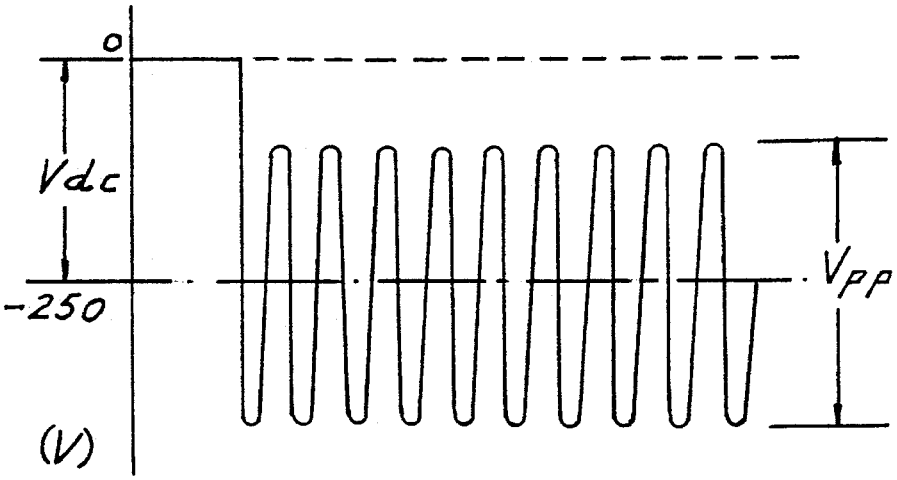
FIG. 4 shows the waveform of a voltage generated by a voltage generating circuit also included in the embodiment.

The voltage generating circuit 100 applies the previously mentioned voltage to the conductive plate 1*b* to charge the drum 3. As shown in FIG. 4, the voltage is made up of an AC component having a peak-to-peak voltage Vpp of 1.2 kV and a DC voltage Vdc of −850 V superimposed on the AC component. Experiments were conducted under the following conditions for the evaluation of image quality. An image was resolved at a resolution R of 300 dpi. The surface of the drum 3 was moved at a speed S, or process speed, of 30 mm/sec. A mesh image having an area ratio of 12.5% was printed with the frequency f of the AC component sequentially changed. The result of experiments are listed in Table 1 below.

TABLE 1

| RESOLUTION (dpi) | PROCESS SPEED (mm/g) | FREQUENCY (Hz) | MESH IMAGE QUALITY |
|---|---|---|---|
| 300 | 30 | 100 | moire |
| | | 200 | moire |
| | | 250 | good |
| | | 300 | good |
| | | 400 | good |
| | | 450 | good |
| | | 500 | white stripes |
| | | 600 | white stripes |

As Table 1 indicates, images of high quality are achievable when the frequency f of the AC component lies in the range of from 250 Hz to 450 Hz. Since the optimal value fO of the AC frequency f (=RS/25.4) is 354 Hz, as calculated by the Eq. (1), an attractive image will be insured if the maximum and minimum values of the frequency f lie in a range determined by the following equation:

$$f=RS/25.4\pm120\ (Hz) \qquad \text{Eq. (2)}$$

Similar experiments for the evaluation of printing quality were conducted, except that the charging member 1, FIGS. 2 and 3, lacked the guard 1*c*, and the resolution R and process speed S were 240 dpi and 33 mm/sec, respectively. The results of such experiments are shown in Table 2 below.

TABLE 2

| RESOLUTION (dpi) | PROCESS SPEED (mm/g) | FREQUENCY (Hz) | MESH IMAGE QUALITY |
|---|---|---|---|
| 240 | 30 | 100 | moire |
| | | 150 | moire |
| | | 200 | good |
| | | 300 | good |
| | | 400 | good |
| | | 450 | white stripes |
| | | 500 | white stripes |
| | | 600 | white stripes |

As shown in Table 2, high image quality is attained when the frequency f of the AC component ranges from 200 Hz to 400 Hz. Since the optimal value fO of the AC frequency f (=RS/25.4) is 312 Hz, desirable images will be obtained if the maximum and minimum values of the frequency f lie in a range satisfying Eq. (2).

Figure 5:
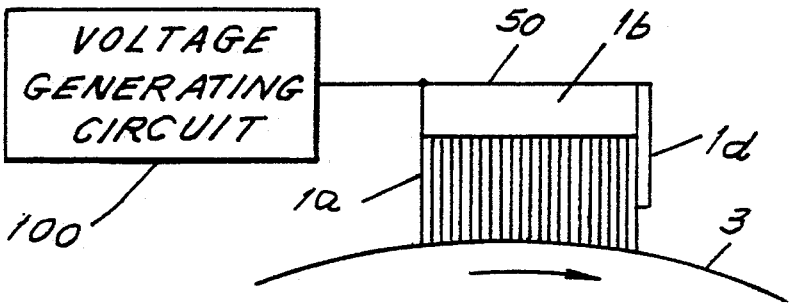
FIG. 5 is a front view of another specific configuration of the charging member.

FIG. 5 shows an alternative configuration of the charging member 1. As shown, a charging member 50 has a guard 1*d* in place of the guard 1*c* of the charging member 1. The guard 1*d* is implemented as a film of PET (Polyethylene Terephthalate). Printing quality was evaluated with the charging device 50, resolution R of 400 dpi, and process speed S of 33 m/sec. The results of evaluation are shown in Table 3 below.

TABLE 3

| RESOLUTION (dpi) | PROCESS SPEED (mm/g) | FREQUENCY (Hz) | MESH IMAGE QUALITY |
|---|---|---|---|
| 400 | 33 | 100 | moire |
| | | 200 | moire |
| | | 300 | moire |
| | | 350 | moire |
| | | 400 | good |
| | | 500 | good |
| | | 600 | good |
| | | 650 | white stripes |
| | | 700 | white stripes |

As shown in Table 3, desirable images are achievable when the frequency f of the AC component ranges from 400 Hz to 600 Hz. Since the optimal value fO of the AC frequency f (=RS/25.4) is 520 Hz, attractive images will be insured if the maximum and minimum values of the frequency f lie in a range satisfying Eq. (2).

Therefore, once the resolution R (dpi) and process speed S (mm/sec) are determined, the voltage generating circuit 100 applies to the charging member a voltage having a DC component superimposed on an AC component whose frequency f lies in a range delimited by the maximum and minimum values of RS/25.4±120 (Hz). The DC voltage Vdc should only be 0.5 kV to 1.2 kV in absolute value, while the peak-to-peak voltage Vpp of the AC component is selected to be slightly higher than the DC voltage. The prerequisite with the peak-to-peak voltage Vpp of the AC component being higher than the discharge start voltage; a sufficient discharge occurs when it ranges from 0.9 kV to 1.3 kV. Under these conditions, not only clear-cut characters are printed without regard to changes in environment, but also mesh images are free from moire and vertical stripes.

Figure 6:
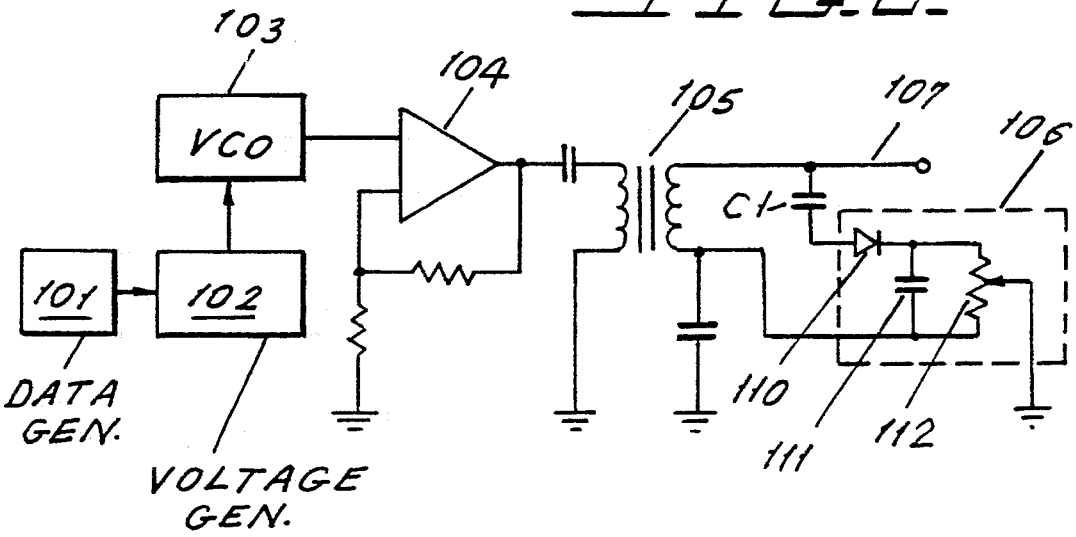
FIG. 6 is a block diagram schematically showing a specific construction of the voltage generating circuit.

FIG. 6 shows a specific construction of the voltage generating circuit 100. As shown, the circuit 100 has a data generator 101, a voltage generator 102, a voltage controlled oscillator (VCO) 103, an amplifier 104, a boosting transformer or booster 105, and a DC bias generator 106. The data generator 101 generates two different kinds of data representing a resolution R (dpi) and a process speed S (mm/sec), respectively. The voltage generator 102 calculates an AC frequency f based on the data R and S and by using Eq. (1) or (2) and outputs the resulting value as a voltage. The VCO 103 generates an oscillation signal having the frequency f out of the voltage from the voltage generator 102. The voltage generator 102 and the VCO 103 is an AC component generating means.

When the resolution R or the process speed S changes, the output data of the data generator changes. As a result, the VCO 103 generates, based on such data, an oscillation signal having an AC frequency f satisfying Eq. (1) or (2). The oscillation signal is amplified by the amplifier 104. The booster 105 boosts the output voltage of the amplifier 104 to 0.5 to 1.2 kV in absolute value. The DC bias generator 106 is connected to the secondary winding of the booster 105 via a capacitor C1. The DC bias generator 106 generates a DC voltage and superimposes it on an AC voltage appearing on the secondary winding of the booster 105 which is superimposing means. The DC bias generator 106 is implemented as a rectifying circuit having a diode 110, a capacitor 111, and a variable resistor 112 whose tap terminal is connected to ground. When the position of the tap terminal is changed, the DC voltage to be superimposed on the secondary winding of the booster 105 changes. As the DC bias generator 106 generates a DC voltage of −850 (V), a voltage having the DC component on the AC component, as shown in FIG. 4, appears on an output terminal 107 and is applied to the conductive plate **1*b*, FIG. 2**; In the illustrative embodiment, an optimal AC frequency is set up at all times in order to insure attractive images without regard to changes in the resolution R or the process speed S.

In FIGS. 2, 3 and 5, the fibers or brush **1*a* of the charging member 1 or 50 should only be implemented by synthetic fibers having a resistance of $10^2$ Ωcm to $10^8$ Ωcm. The voltages of the AC component and DC component depend on the resistance of the fibers. To protect the surface of the drum 3 from scratches and to insure stable contact, each of the fibers 1*a* is provided with a thickness of 1.5 denier to 15 denier and a length of 2 mm to 10 mm and implanted in a density of 50,000/inch$^2$ to 500,000/inch$^2$. The guard 1*c* preventing the fibers 1*a*** from collapsing, may be comprised of an urethane sheet, insulative film, or a foam insulator.

While the embodiment has concentrated on a photoconductive drum, the present invention is, of course, practicable with a photoconductive element in the form of a plane belt.

The drum 3 is made up of an aluminum tube, a high resistance coating formed on the tube by anodic oxidation, and a photoconductive film and a protective film sequentially formed on the coating. Such a laminate structure reduces pin holes and, therefore, prevents the brush-from melting in the event of charging.

The present invention is practicable not only with a charging device using a brush but also with a charging device using a roller which contacts a body to be charged. In any case, the present invention insures attractive images free from moire and vertical stripes.

What is claimed:

1. A charger for charging an image holding member included in an image forming apparatus which prints an image by an electrophotographic process, said charger comprising:

a charging member for charging a surface of said image holding member in contact with said surface; and a voltage generating circuit for generating, assuming that said image forming apparatus has a resolution R (dpi) and a process speed S (mm/sec), a voltage consisting of an AC component having a frequency f which lies in a range having a maximum value and a minimum value determined by RS/25.4±120 (Hz) and a DC component superimposed on said AC component and for applying said voltage to said charging member.

2. The charger as claimed in claim 1, wherein said AC component has a peak-to-peak voltage higher than a discharge start voltage.

3. The charger 1 as claimed in claim 2, wherein said charging member comprises a brush having a plurality of fibers contacting said image holding member.

4. The charger as claimed in claim 3, wherein said peak-to-peak voltage ranges from 0.5 kV to 1.3 kV, and said DC component having a voltage ranging from 0.5 kV to 1.2 kV.

5. The charger as claimed in claim 3, wherein said charging member comprises a plurality of fibers made of synthetic resin and contacting said image holding member, and a conductive plate connected to one end of said plurality of fibers, said fibers each having a thickness of 1.5 denier to 15 denier and a length of 2 mm to 10 mm and being implanted in said conductive plate in a density of 50,000/inch$^2$ to 500,000 inch$^2$.

6. The charger as claimed in claim 5, wherein said charging member further comprises a guard for preventing said plurality of fibers from collapsing.

7. The charger as claimed in claim 1, wherein said voltage generating circuit comprises:

a data generator for generating data of said resolution R and said process speed S, means, responsive to said data, for generating said AC component having said frequency f, means, for generating said DC component, and superimposing means for superimposing said DC component on said AC component.

8. A charger for charging an image holding member included in an image forming apparatus which prints an image by an electrophotographic process, said charger comprising:

a charging means for charging a surface of said image holding member in contact with said surface; and a voltage generating means responsive to a resolution of said image and a process speed for generating a voltage containing an AC component having a frequency defined according to said resolution and said process speed and a DC component, and for applying said voltage to said charging means.

* * * * *